US005536314A

United States Patent [19]

Rannestad

[11] Patent Number: 5,536,314

[45] Date of Patent: Jul. 16, 1996

[54] INKING ROLLER ASSEMBLY FOR WEB PRINTING

[75] Inventor: Per G. Rannestad, Skedsmokorset, Norway

[73] Assignee: GP-Tinter AS, Skjetten, Norway

[21] Appl. No.: 367,173

[22] Filed: Dec. 29, 1994

[30] Foreign Application Priority Data

Jul. 8, 1992 [NO] Norway ..... 922678

[51] Int. Cl.[6] ..... B05C 1/00

[52] U.S. Cl. ..... 118/224; 101/350; 118/242; 118/249; 118/262

[58] Field of Search ..... 118/224, 242, 118/249, 255, 258, 262; 427/428; 101/350, 363, 364, 351, 352

[56] References Cited

U.S. PATENT DOCUMENTS

| | | | |
|---|---|---|---|
| 3,293,691 | 8/1942 | Harrigan | 118/249 |
| 3,647,525 | 3/1972 | Dahlgren | 427/428 |
| 3,676,184 | 7/1972 | Spearin et al. | 118/224 |
| 4,361,090 | 11/1982 | Klinger et al. | 101/350 |
| 4,567,823 | 2/1986 | Hummel et al. | 118/258 |
| 4,590,856 | 5/1986 | Mamberer et al. | 101/350 |
| 4,610,216 | 9/1986 | Pualsen | 118/249 |
| 4,766,841 | 8/1988 | Brown et al. | 118/75 |
| 4,787,312 | 11/1988 | Basetto | 101/350 |
| 5,046,418 | 9/1991 | Koehler et al. | 101/350 |

FOREIGN PATENT DOCUMENTS

| | | |
|---|---|---|
| 0037682 | 10/1981 | European Pat. Off. . |
| 2609982 | 9/1976 | Germany . |
| 3127880 | 1/1983 | Germany . |
| 1201233 | 8/1970 | United Kingdom . |
| 2074053 | 10/1981 | United Kingdom . |

*Primary Examiner*—Laura Edwards
*Attorney, Agent, or Firm*—Palmatier, Sjoquist & Helget

[57] ABSTRACT

The invention relates to a paper coloring apparatus for especially water colors or water-based inks, wherein a driven running paper web is positioned around a turning roller constituting the counter pressure roller for an inker and, together with the latter, are included in a roller train adapted to convey ink from a reservoir to the inker. One has aimed at transferring ink to the paper in so small amounts that after-drying of the paper becomes unnecessary. According to the invention, the roller train is adapted to be driven by means of the running paper web and comprises five or more rollers.

11 Claims, 7 Drawing Sheets

INKING ROLLER ASSEMBLY FOR WEB PRINTING

BACKGROUND OF THE INVENTION

The present invention related to a paper coloring apparatus for especially water colors or water-based inks.

Today, coloring paper in the form of a running web with water-based inks is effected by means of various kinds of coloring or painting apparatus and/or printing processes.

The main disadvantage of methods of today is that relatively large amounts of ink (more than 1,5 grams/$m^2$) are transferred to the paper web. As water well may constitute 90% of the ink, this will lead to a relatively large water supply to the paper, involving a swelling of the paper fibers; the physical properties (dimensional stability, rigidness, etc.) of the paper getting lost or being substantially deteriorated. In order to stabilize the paper again subsequent to such conventional coloring, it is necessary to after-dry it by means of suitable equipment (hot air blowing, radiation using infrared rays, microwave-treatment, etc.). Usually, this is expensive, space-demanding and complex.

In a known coloring apparatus of the kind concerned, a color roller rotates partly submerged into a color basin, and cooperates with an overlying intermediate roller to which the color roller transfers coloring matter. On its part, the intermediate roller transfers coloring matter supplied thereto to an overlying inking-up roller which is adapted to transfer coloring matter supplied thereto to a running paper web. These three rollers have mutually parallel rotation axes.

It has been found that the adjustment of the relative positions of the rollers and pressure against each other greatly influence the amount of color transferred between the rollers. A weak pressure from a roller gives another transferred color amount than a hard roller pressure. Therefore, it is important that the pressure is constant along the line of contact between the rollers, in order to achieve an even color transfer laterally of the paper web.

In today's methods, the roller positions are usually adjusted by means of mechanical and/or electrical mechanisms, requiring much time and high professional capability. Usually, the adjustments have also to be tested out in order to control them.

As the roller pressure influences the transferred amount of color, it will also influence the amount of water transferred between the rollers when using water colors. This can lead to great problems adhering to the adjustment of the drying equipment, so that the paper subsequent to drying receives the correct conditioning (water content).

Mechanical adjustment of rollers as well as controlling their relative rotation speeds by means of either fixed gear transmissions or electric motors of their own require more energy for operation than the paper web is capable of supplying without allowing the paper tension to increase too much. Therefore, these roller systems require energy supply in order to operate. This supply of energy is usually taken from the main motor for the machine on which the paper coloring apparatus is mounted. Usually, such a coupling makes it more complex and expensive to find a suitable positioning of the paper coloring apparatus at already existing production machines.

SUMMARY OF THE INVENTION

An object of the present invention has been to eliminate or substantially reduce deficiencies, disadvantages and limitations of application of paper coloring apparatus of the kind concerned.

Thus, a specific object of the invention consists in eliminating or strongly restricting the need for after-drying of the paper inked up, through reducing the transferred amount of color substantially, e.g., to the order of 0,5 grams per $m^2$. With such an insignificant (in relation to conventional technique) amount of color transferred, the transferred amount of water becomes so small that it will have a quite insignificant influence on the physical properties and stability of the paper, simultaneously as a satisfactory coloring/inking-up result is maintained.

Moreover, one has aimed at eliminating or strongly restricting the need for adjustment of roller position and pressure along the contact line of the rollers.

In accordance with the invention, said objects are realized through designing the paper coloring apparatus such that it exhibits the features defined in the following claims.

A paper coloring apparatus adapted for the transfer of water colors in so small amounts to a running paper web that after-drying of the paper is unnecessary or substantially unnecessary, distinguishes itself, e.g., through comprising a roller train consisting of five or more rollers, preferably driven by the running paper web, and which, as known per se, transfers colors from a color vessel through the roller train to the paper web.

Another feature of the invention consists in that each roller is rotatably suspended, with a breaking effect in the suspension securing an automatically correct distribution of the color through the roller train, such that color cannot accumulate within the roller train.

Preferably, every other roller in the roller train is stationarily suspended, while each of the remaining rollers is floatingly suspended, using floating bearings, in that the floatingly suspended rollers individually are assigned pressure fluid operated piston cylinders adapted to displace the associated rollers into position toward the stationarily suspended rollers as well as out of contact with the latter. Thereby, a constant pressure along the contact line of adjacent rollers may be achieved automatically. Also, this pressure will be independent on the rotation speed of the rollers. The roller pressure is constant along the contact line, and the magnitude of the pressure is controlled directly through the regulation of the fluid pressure supplied to the piston cylinders.

The floating suspension of some rollers of the roller train makes the paper coloring apparatus insensitive to smaller variations in roller diameter because of temperature changes, wearing or grinding of rollers.

According to a further feature of the paper coloring apparatus, the roller train is graded, the ends of an overlying roller in the roller train being axially withdrawn in relation to the ends of an underlying roller. Thereby, the roller train receives an upwardly tapering shape from the color vessel and up toward the uppermost roller (the counter pressure roller). Such a design prevents accumulation of color on the roller ends.

As mentioned, the pressure along the contact line will be constant at varying speed, as the pressure between the rollers never can become larger than the pressure applied from the piston cylinders (presupposed one cylinder at each end of every floatingly suspended roller). The rollers will automatically increase the center distance therebetween with increasing speed, in order to reduce the pressure building up between the rollers due to rotation and transport of color.

Altogether, this leads to the fact that the need for energy necessary to operate a paper coloring apparatus of the present invention is approximately constant and independent on the speed. Again, this renders it possible to operate the roller train by means of the running paper web only. In known systems having locked roller positions, the pressure and the energy need between the rollers will increase with increasing speed, rendering it practically impossible to operate the roller train by means of the running paper web.

Another advantage of the roller positioning system in the paper coloring apparatus of the invention is that one (without changing the adjustment) may replace rollers with others having different diameters, said system automatically causing the new rollers to be brought into correct position.

This is very important, as the roller diameter changes during operation due to wearing and tearing, temperature, etc. Recently ground rollers can also be mounted directly without having to change the adjustment. This saves time and secures a uniform quality.

DESCRIPTION OF THE PREFERRED EMBODIMENT

Figure 1A:
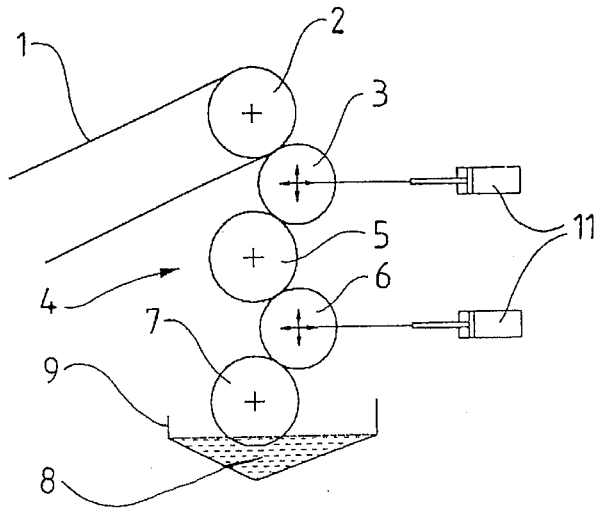
FIGS. 1A and 1B show a paper coloring apparatus according to a first embodiment of the invention, seen in an end view and a side view, respectively.
Figure 1B:
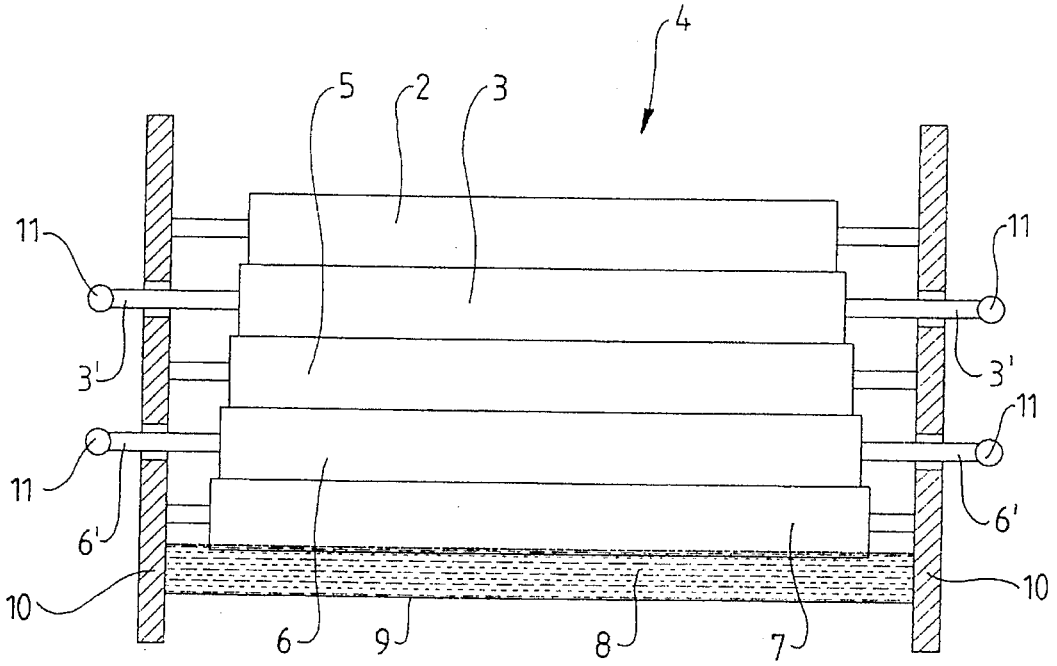

In a first embodiment of a paper coloring apparatus according to the invention, FIGS. 1A and 1B, a running paper web is denoted by the reference numeral 1. The paper web is positioned around a counter pressure roller 2 which, through the paper web 1, cooperates with an inking-up roller or inker 3 which, together with the counter pressure roller 2, are incorporated into a roller train 4. The inker 3 cooperates with an underlying first intermediate roller 5 which, on its part, cooperates with an underlying second intermediate roller 6 which, again, cooperates with the color reservoir roller 7, which is partly submerged into color or ink 8 in an ink reservoir 9.

Ink 8 from the reservoir 9 is transferred to the paper web 1 through the rollers 7, 6, 5, 3 of the roller train 4. reservoir 9.

Ink 8 from the reservoir 9 is transferred to the paper web 1 through the rollers 7, 6, 5, 3 of the roller train 4.

The rollers 2, 5, 7 are hard rollers, e.g., consisting of metal having a polished surface. These rollers are mounted stationary between side plates 10, FIG. 1B.

The rollers 3 and 6 are made from a soft material, e.g., rubber, and exhibit a smooth surface. These rollers 3, 6 are mounted in floating bearings arranged in the side plates 10, such that they may move freely in all directions. Each roller 3, 6 is mounted together with pneumatic or hydraulic piston cylinders 11, acting in pairs, one at each end of the respective roller 3, 6. These piston cylinders 11 may be mounted in various ways, either on the inner side or outer side of the side plates 10. In FIG. 1, an external mounting has been shown, wherein the roller shaft ends 3', 6' pass freely through holes in the side plates 10.

The roller train 4 is graded and tapers in an upward direction from the lowermost roller 7 to the uppermost roller 2, the rollers 7, 6, 5, 3, 2 successively exhibiting a shorter length than the underlying, such that the ends of an overlying roller, e.g. 5, are axially withdrawn in relation to the ends of the underlying roller, e.g. 6. Such a graded roller train 4 involves the technical effect that accumulation of ink on the ends of the rollers is avoided.

In the embodiment of FIG. 1, and insofar the remaining, following embodiments, the individual rollers 2, 3, 5, 6, 7 are arranged without a drive device of their own, the roller suspensions of the paper coloring apparatus of the invention rendering it possible to operate the roller train 4 by means of the running paper web 1, which is very difficult or impossible with conventional paper coloring apparatus.

In order to start ink transfer to the paper web 1 through the rollers 3, 5, 6 and 7, said rollers are caused to rotate by means of the paper web 1, whereby ink 8 is conveyed upwards to the nip between the rollers 7, 6 and, further, to the nip between the rollers 6, 5, and therefrom to the nip between the rollers 5, 3, from where ink carried thereto is transferred to the paper web 1 from the roller 3, while the roller 2 acts as counter pressure roller.

Within each of the contact lines between the rollers, the ink will act as a lubricant. This will result in a situation wherein relative speed between the rollers is reduced downward within the roller train 4, due to the fact that the rollers will slide in relation to each other. The transferred amount of ink will (due to the relative speed difference) be reduced upward within the roller train.

Figure 2:
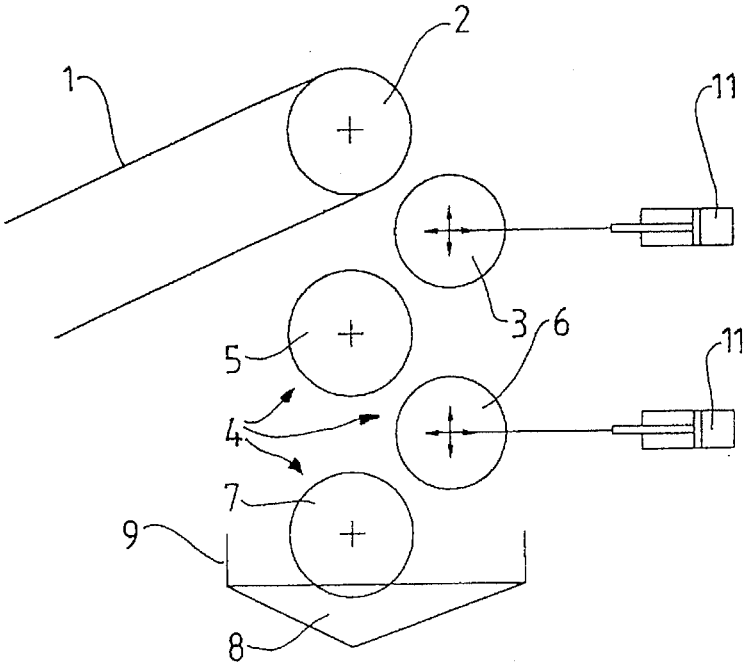
FIG. 2 corresponds to FIG. 1A, but shows two floatingly suspended intermediate rollers of the roller train withdrawn to inoperative position, corresponding to stoppage.

FIG. 2 shows a coloring apparatus of the embodiment according to FIG. 1, seen in an inoperative position, wherein the inker 3 and the intermediate roller 6 are withdrawn from contact with the other rollers 2, 5, 7 by means of the pneumatic or hydraulic piston cylinders 11.

Figure 3:
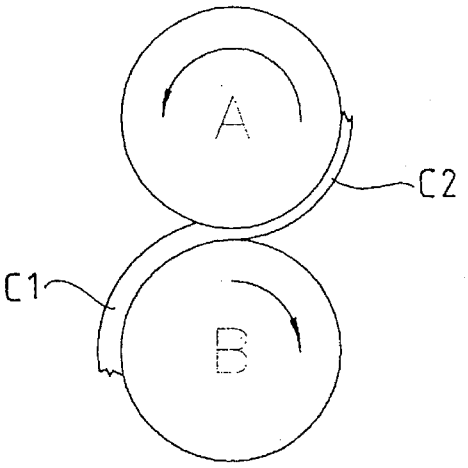
FIG. 3 shows in an end view two rollers of the roller train, wherein one (the overlying) roller has a higher rotational speed than the other, the figure illustrating the effect of relative speed on the distribution of color amount from the underlying roller to the overlying roller of the roller train.

The above-mentioned slide effect is illustrated in FIG. 3, wherein an upper roller A (e.g., roller 5 in FIGS. 1A, 1B and 2), due to said slide effect, has a larger speed than an underlying roller B (e.g., roller 6). Then, roller B will distribute the amount of ink on roller A across a larger area; the latter roller, consequently, receiving a thinner layer of ink C2 than the ink layer C1 on roller B.

The magnitude of said slide effect will be dependent on the mechanical braking of the individual roller within the bearings thereof, and on the physical lubricating properties of the ink.

Figure 4A:
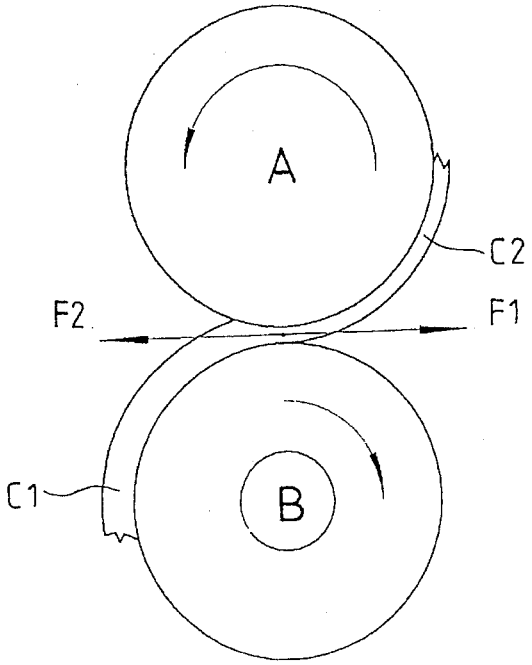
FIG. 4A and 4B correspond to FIG. 3 and illustrate color transfer and distribution with low braking force (FIG. 4A) and higher braking force (FIG. 4B) within the suspension for the lower roller.
Figure 4B:
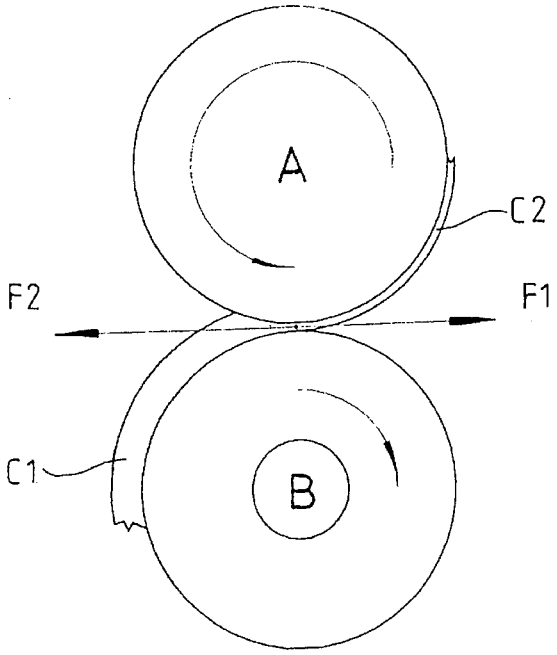

FIGS. 4A and 4B illustrate how increasing braking (FIG. 4B in relation to FIG. 4A) results in a thinner ink layer C2, FIG. 4B, using the same ink. A thin layer of ink transfers more power than a thicker layer C2, FIG. 4A, and balances, in this manner, the increased friction force F2, against the driving force F1, FIG. 4B.

Figure 5A:
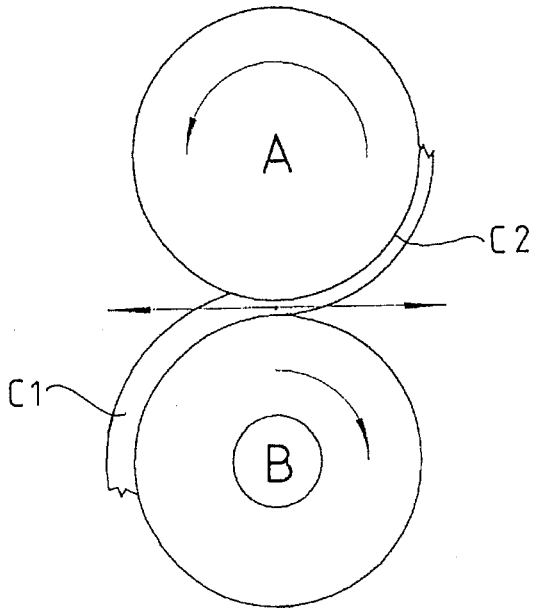
FIG. 5A and 5B correspond to FIG. 3 and 4A, 4B and illustrate how a color/ink having higher (better) lubricating properties reduces the color amount transferred, the color used in FIG. 5B being assumed to have better lubricating properties than the color used in FIG. 5A, wherein the color offers a higher friction.
Figure 5B:
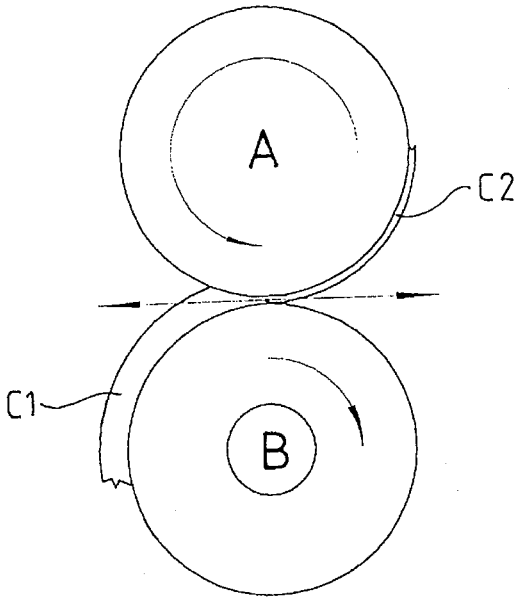

FIG. 5A and 5B illustrate how an ink having better lubricating properties reduces the amount of ink transferred. With the roller nip of FIG. 5A, an ink is used having lubricating properties inferior to those of the ink used with the roller nip according to FIG. 5B, wherein the ink C2 transferred from roller B to roller A has a layer thickness which is smaller than the layer thickness of the ink C2 transferred from roller B to roller A according to FIG. 5A.

Figure 6:
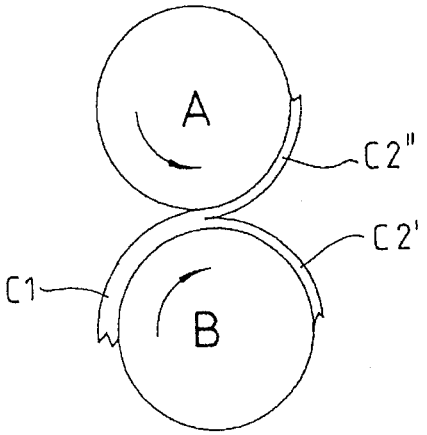
FIG. 6 shows, also in an end view, two cooperating rollers included into a roller train of paper coloring apparatus according to the invention, illustrating how the color film is being split when passing through a roller nip between two rollers, leading to a reduction of the amount of color transferred.

Another effect influencing the ink film transferred consists in that the latter is being split when it passes through a roller nip between two rollers A and B, confer FIG. 6, wherein the splitting of the ink film is denoted C2" (ink layer following the roller A upwardly) and C2'. This effect also causes a reduction of the amount of ink transferred.

Figure 7:
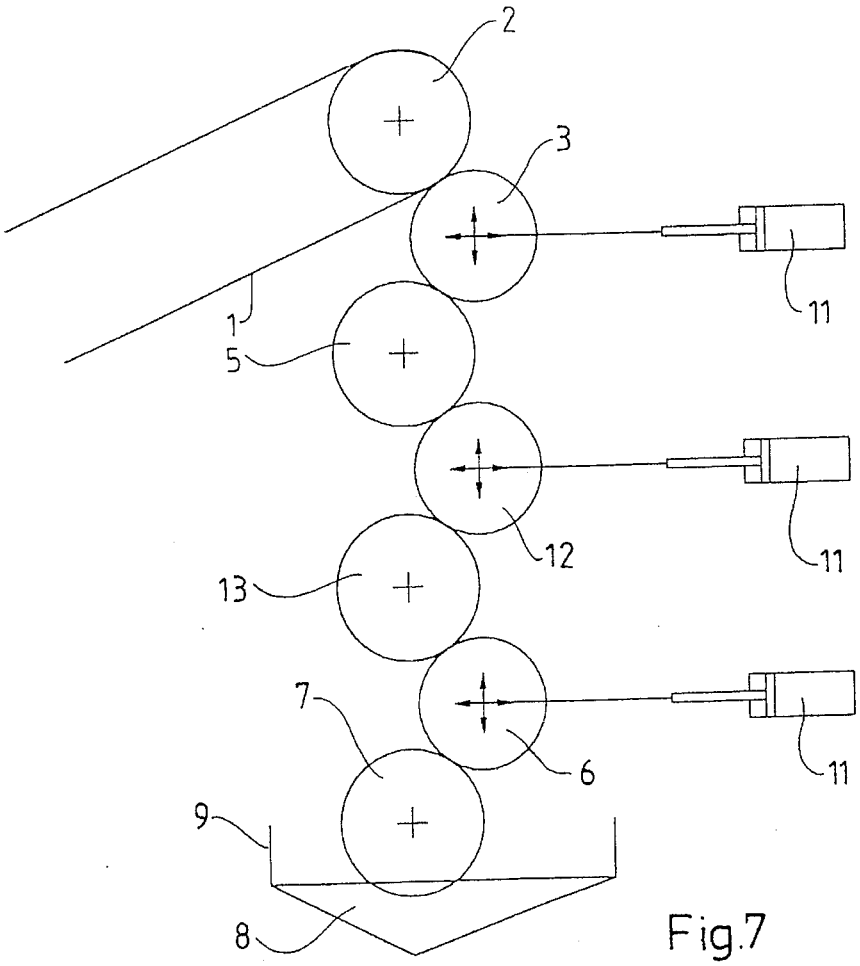
FIG. 7 shows in an end view a paper coloring apparatus, wherein the roller train comprises seven rollers.

FIG. 7 shows an embodiment of a paper coloring apparatus which, in relation to the roller train of FIGS. 1A, 1B and 2, comprises two further rollers 12 and 13, namely a soft roller 12 floatingly suspended and equipped with flexible operating means in the form of pneumatic or hydraulic piston cylinders 11, as well as a hard roller 13 stationarily suspended.

Figure 8A:
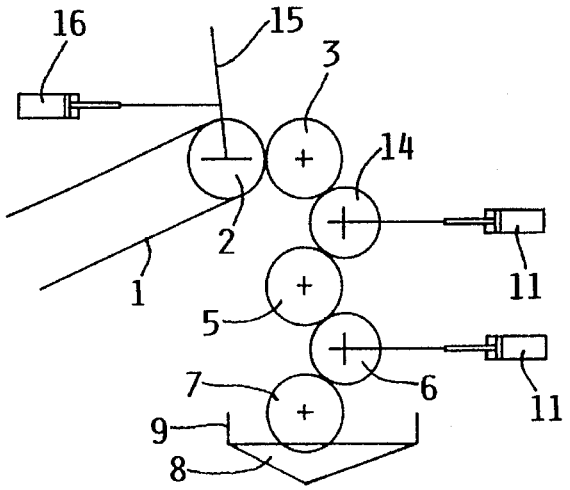
FIGS. 8A, 8B and 8C show in end views a roller train comprising six rollers, wherein the counter pressure roller may be moved toward the coloring roller by means of a pendulum suspension.
Figure 8B:
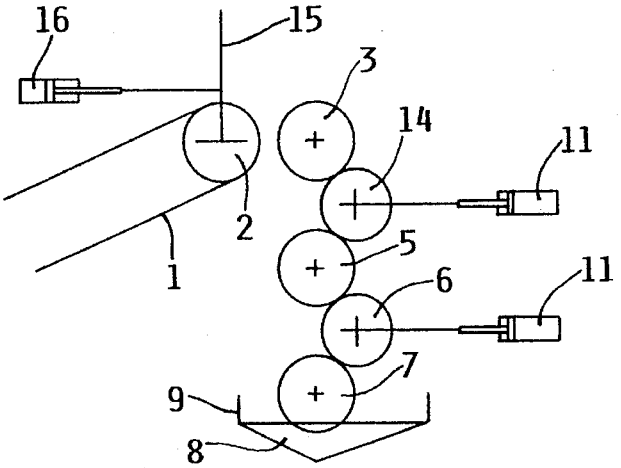
Figure 8C:
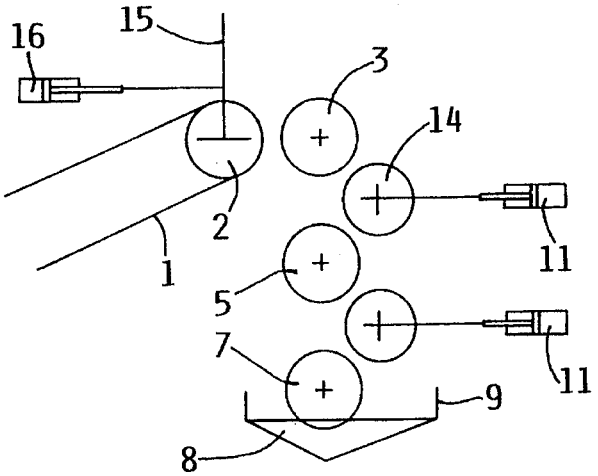

FIGS. 8A, 8B and 8C show a further embodiment of the paper coloring apparatus according to the invention, wherein the roller train comprises six rollers, the extra roller in relation to FIGS. 1A, 1B and 2 being denoted by reference numeral 14, and wherein the counter pressure roller 2 is pendulum suspended 15 and being moved toward and away from the inker 3 by means of hydraulic or pneumatic piston cylinder 16. FIG. 8A shows the paper coloring apparatus in an operative position, while FIG. 8B shows it in an idling position and FIG. 8C the same in an inoperative position.

Figure 9A:
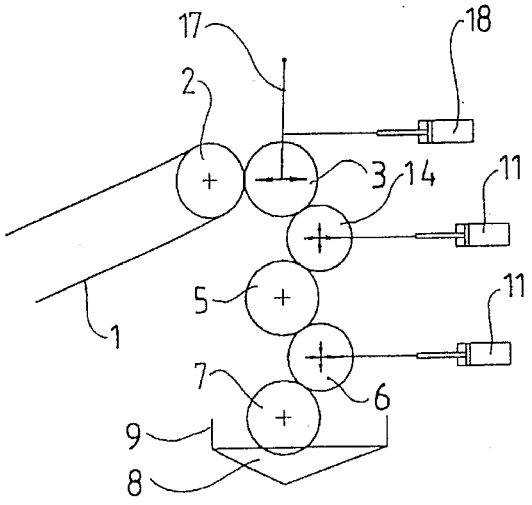
FIGS. 9A, 9B and 9C show a roller train, wherein the uppermost coloring roller is pendulum suspended.
Figure 9B:
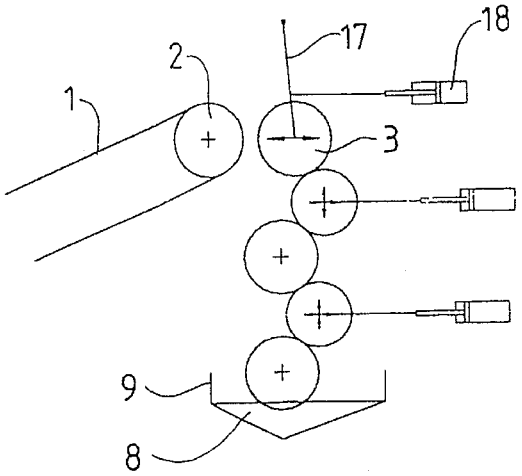
Figure 9C:
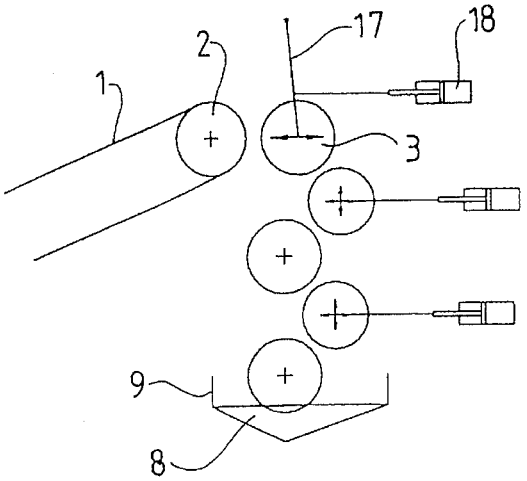

FIGS. 9A, 9B and 9C show substantially the same embodiment as in FIGS. 8A–8C, but in the former figures, the inker 3 is pendulum suspended 17 and assigned a flexible operating means in the form of hydraulic or pneumatic piston cylinders 18. The 10 positions shown correspond to those in FIGS. 8A–8C.

The solutions shown in FIGS. 8 and 9 enable the rollers to be driven by a motor of their own when the paper web 1 is not running. This may be an advantage in order to avoid that ink dries on the rollers.

Operating the rollers by means of the paper web 1 secures correct distribution of the ink. Ink cannot accumulate at a higher level within the roller train, which automatically would have resulted in relative skidding of the rollers in relation to each other, as well as in an increase in the relative speed between the rollers, simultaneously as the amount of ink transferred would have been reduced. Thereby, according to the invention, a self-adjusting roller train has been provided, securing a correct and uniform distribution of ink from the ink reservoir 9 to the paper web 1. Through increasing the braking of the individual rollers within the bearings thereof, the relative difference of speed between the rollers may be increased, thereby further reducing the amount of ink transferred.

At each roller contact line, one obtains a reduction of the amount of ink transferred, due to the difference between the relative speed of the rollers (FIGS. 4A, 4B and FIGS. 5A, 5B), as well as a splitting of the ink film (FIG. 6). Through the arrangement of a sufficient number of roller pairs, the amount of ink transferred may be reduced to a minimum.

Tests have shown that when using a roller train 4 comprising five rollers (FIGS. 1A, 1B, FIG. 2), the amount of ink transferred can be reduced to 0,3 grams/$m^2$.

What is claimed is:

1. Paper coloring apparatus for water colors or water-based inks comprising a driven, running paper web (1) positioned around a turning roller (2) constituting a counter pressure roller for an inker roller (3) and, together with the latter, are included in a roller train (4) to convey ink (8) from a reservoir (9) to the web (1), wherein said roller train includes at least five rollers (2, 3, 5, 6, 7), of which some have a floating position in relation to the other, and that each roller in the roller train is resting directly against an adjacent roller and the inker roller (3) is resting against the paper web (1), the roller train (4) being driven by the running paper web, through the direct contact between adjacent rollers, whereby alternate rollers are metal rollers (2, 5, 7) and the remaining rollers (3, 6) are rubber rollers each of said rubber rollers being floatingly suspended and connected to an actuator, said actuator comprising a pressure drive piston and cylinder.

2. Paper coloring apparatus as set forth in claim 1 wherein said roller train further comprises successive, upwardly positioned rollers, from a lowermost roller to an uppermost roller, successive upper roller being shorter in length than the adjacent lower roller.

3. Paper coloring apparatus as set forth in claim 1, wherein said counter pressure roller is supported by means of a pendulum suspension (15) connected to an actuator (16), said actuator comprising a pressure drive piston and cylinder.

4. Paper coloring apparatus as set forth in claim 1, wherein said inker roller (3) is supported by means of a pendulum suspension (17) connected to a pressure fluid driven piston cylinder (18), the counter pressure roller (2) being stationarily suspended.

5. In a paper coloring apparatus for applying water colors and water-based inks, wherein a driven, running paper web is positioned around a turning roller and having a roller train for conveying water colors and water-based ink from a reservoir to the paper web, the improvement comprising said roller train having at least five rollers being driven by said turning roller, including an inker roller contacting and being driven by said turning roller, each roller in said train having a contact position with an adjacent roller; wherein said turning roller and alternating ones of rollers in said train are metal rollers and intermediate alternating ones of rollers in said train are rubber rollers; further comprising means, connected to at least one of said rollers, for withdrawing said at least one roller from said contact position with respective adjacent rollers.

6. The apparatus of claim 5, wherein said roller train is vertically aligned, with said rollers positioned from a lower reservoir position to a higher turning roller position.

7. The apparatus of claims 6, further comprising said roller train having rollers of respective lesser lengths from the lower reservoir position to the higher turning roller position.

8. The apparatus of claims 5 or 6, further comprising means, connected to said turning roller, for swinging said turning roller into contact position against said inker roller.

9. The apparatus of claim 8, wherein said means for swinging further comprises a pendulum connection to said turning roller.

10. The apparatus of claims 5 or 6, further comprising means, connected to said inker roller, for swinging said inker roller into contact position against said turning roller.

11. The apparatus of claim 10, wherein said means for swinging further comprises a pendulum connection to said inker roller.

* * * * *

UNITED STATES PATENT AND TRADEMARK OFFICE

CERTIFICATE OF CORRECTION

PATENT NO. : 5,536,314

DATED : July 16, 1996

INVENTOR(S) : Per G. Rannestad

It is certified that error appears in the above-indentified patent and that said Letters Patent is hereby corrected as shown below:

On title page under "[56] References Cited" "3,293,691 8/1942 Harrigan" should be -- 2,293,691 8/1942 Harrigan --; and "4,610,216 9/1986 Pualsen" should be -- 4,610,216 9/1986 Paulsen --.

Column 5, line 45, "The 10 positions" should be -- The positions --.

Column 6, line 28, claim 2, "roller, successive" should be -- roller, with each successive --.

Signed and Sealed this

Third Day of December, 1996

Bruce Lehman

*Attest:*

BRUCE LEHMAN

*Attesting Officer*

*Commissioner of Patents and Trademarks*